US006491367B1

(12) United States Patent
Miyasaka et al.

(10) Patent No.: US 6,491,367 B1
(45) Date of Patent: Dec. 10, 2002

(54) PRINTER, A PRINTER CLEANING METHOD, AND A CLEANING METHOD STORAGE MEDIUM

(75) Inventors: Masayo Miyasaka, Shiojiri (JP); Mitsuaki Teradaira, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/500,756

(22) Filed: Feb. 8, 2000

(30) Foreign Application Priority Data

Feb. 8, 1999 (JP) ..... 11-030034

(51) Int. Cl.[7] ..... B41J 2/165
(52) U.S. Cl. ..... 347/23
(58) Field of Search ..... 347/23, 7, 22, 347/36

(56) References Cited

U.S. PATENT DOCUMENTS

| | | | | |
|---|---|---|---|---|
| 5,382,969 A | | 1/1995 | Mochizuki et al. | |
| 5,712,667 A | | 1/1998 | Sato | |
| 5,997,121 A | * | 12/1999 | Altfather et al. | 347/7 |
| 6,042,218 A | * | 3/2000 | Nakahara | 347/35 |
| 6,166,828 A | * | 12/2000 | Yamada et al. | 358/1.8 |

FOREIGN PATENT DOCUMENTS

| | | | | |
|---|---|---|---|---|
| EP | 0 552 472 A2 | | 7/1993 | |
| EP | 0 640 483 A2 | | 3/1995 | |
| EP | 0 654 757 | | 5/1995 | |
| EP | 0 778 140 A2 | | 6/1997 | |
| EP | 0 841 173 A2 | * | 5/1998 | B41J/2/175 |
| JP | 5-169668 | | 7/1993 | |
| JP | 7-89090 | | 4/1995 | |
| JP | 9-11490 | | 1/1997 | |
| JP | 9-277560 | | 10/1997 | |
| JP | 11-200873 | | 7/1999 | |

OTHER PUBLICATIONS

US 5,635,961, 6/1997, Sato (withdrawn)

* cited by examiner

*Primary Examiner*—Thinh Nguyen

(57) ABSTRACT

The present invention is directed to a printer with a cleaning function in which CPU 103 monitors a detection switch, and performs cleaning and printing operations as required until the detection switch is pressed(step S601). When the detection switch is pressed (step S602 returns yes), the printer 101 indicates a "near end of ink" notice using the display panel 112 or by flashing an LED, for example. A near end of ink notice is also sent to the host computer 120 (step S603). A remaining ink volume counter is then set to a specific value, which in this exemplary embodiment is 5 mg (step S604). When a print command is next received (step S605 returns yes), the ink consumed by the print operation is subtracted from the remaining ink volume, and the difference is stored as the new remaining ink volume (step S606). The CPU 103 then waits for a cleaning command (step S607). When a cleaning command is received, the CPU 103 calculates the ink volume required for the cleaning operation, that is, the above-noted cleaning volume (step S608). If the cleaning volume is greater than the remaining ink volume (step S609 returns no), the cleaning mechanism is not driven, the user is notified that ink tank replacement is required using an LED, display panel 112, and/or notifying the host computer 120 (step S611), and the printing process ends. If the cleaning volume is less than the remaining ink volume (step S609 returns yes), ink jet head cleaning is possible. The cleaning mechanism is therefore driven (step S610) to suction an ink volume determined by the selected cleaning method, and this cleaning process ends.

24 Claims, 7 Drawing Sheets

OIPE JC109
OCT 0 3 2002
PATENT & TRADEMARK OFFICE

P4894a, Serial No. 09/500,7
Customer No. 20178

PRINTER, A PRINTER CLEANING METHOD, AND A CLEANING METHOD STORAGE MEDIUM

BACKGROUND OF THE INVENTION

1. Field of the Invention

The present invention relates to a printer, a cleaning method for the printer, and a data storage medium for storing the printer cleaning method as a computer-readable program. More specifically, the present invention relates to an ink jet printer capable of detecting the remaining ink volume and determining whether to perform a cleaning method. The present invention further relates to the cleaning method of the printer, and to a data storage medium for storing a computer-readable program accomplishing this cleaning method.

2. Description of the Related Art

Ink jet printers are commonly used for printing text and images to paper, film, and other print media by ejecting ink from a plurality of nozzles.

The ink jet head in such ink jet printers typically conducts ink through a tube from an ink tank to an ink reservoir inside the ink jet head, and then ejects the ink from selected nozzles by deforming a diaphragm with, for example, electrostatic force or the piezoelectric effect of a piezoelectric element. Another type of ink jet head uses a so-called thermal jet method to eject ink from the nozzles. Yet another type of ink jet head eliminates the ink tube by integrating the ink tank in the ink jet head, installing the ink tank on the carriage with the ink jet head. The ink tank in this case is replaceable.

Various methods are also used to clean the ink jet head and prevent build-up of viscous ink on the nozzle surface, bubbles from entering the ink path through the nozzles, ink leakage at the nozzle surface, and other problems. These cleaning methods include: wiping the nozzle surface, flushing ink from the nozzles, and capping the nozzles and then pumping ink from the nozzles through the cap.

Some of the problems with these conventional methods are described below.

Ink stored in the ink tank is used for cleaning the print mechanism. As a result, if the ink supply is depleted during the cleaning operation and there is a hole in the ink tank, air will be introduced to the ink supply path.

Furthermore, if the ink supply is depleted during the cleaning operation and replacing the ink tank thus becomes necessary, the time consumed to that point by the print mechanism cleaning operation will have been wasted. The print mechanism cleaning operation is a particularly time-consuming operation, and it is therefore desirable to avoid consuming excess time as a result of cleaning operations that cannot be completed and must be repeated.

The cleaning method used may also be varied to, for example, only wipe the nozzle surface or adjust the ink suction volume, depending on the reason why cleaning must be performed. Some of the reasons why it is desirable to change the specific cleaning method used include: initial charging required by ink tank replacement; the length of time the printer power has been off; when nothing has been printed for a specific period of time; and a manual request of a cleaning operation. In these cases it is desirable and necessary to appropriately adjust the amount of ink used for the cleaning operation, and it is necessary to address this need.

There is therefore a need for a printer and a printer cleaning method whereby the time consumed for the cleaning operation can be minimized and the cleaning operation can be dynamically adjusted to the current cleaning requirements.

OBJECTS OF THE INVENTION

Therefore, it is an object of the present invention to overcome the aforementioned problems.

With consideration for the above-described problems, an object of the present invention is therefore to provide an ink jet printer for detecting the remaining ink supply and determining whether to perform a cleaning operation.

A further object of the present invention is to provide a cleaning method for this printer, and to provide a data storage medium for storing this cleaning method as a computer-readable program.

SUMMARY OF THE INVENTION

To achieve this object, a printer according to the present invention comprises (a) an ink jet head for printing text or images; (b) an ink tank for storing ink used by the ink jet head during printing, the ink tank being connected through to the ink jet head; (c) a cleaning mechanism for cleaning the ink jet head using ink stored in the ink tank; (d) a detection unit for detecting a command instructing ink jet head cleaning; (e) an evaluation unit for determining whether cleaning is possible based on an ink volume remaining in the ink tank and an ink volume consumed by the cleaning mechanism for cleaning when the detection unit detects a command instructing ink jet head cleaning; and (f) a control unit for driving the cleaning mechanism to clean the ink jet head when the evaluation unit determines that cleaning is possible.

A further printer according to the present invention comprises: (a) an ink jet head for printing text or images; (b) an ink tank for storing ink used by the ink jet head during printing, the ink tank being connected through to the ink jet head; (c) a cleaning mechanism for cleaning the ink jet head using ink stored in the ink tank; (d) a detection unit for detecting a command instructing ink jet head cleaning; (e) an evaluation unit for determining whether cleaning is possible based on an ink volume remaining in the ink tank and an ink volume consumed by the cleaning mechanism for cleaning when the detection unit detects a command instructing ink jet head cleaning; and (g) a notification unit for notifying when the evaluation unit determines that cleaning is not possible.

To further achieve the above objects, the present invention also provides a printer cleaning method comprising: (a) a detection step for detecting a command instructing ink jet head cleaning using ink stored in an ink tank; (b) an evaluation step for determining whether cleaning is possible based on an ink volume remaining in the ink tank and an ink volume used for cleaning when the detection step detects a command instructing cleaning; and (c) a cleaning step for cleaning the ink jet head using ink stored in the ink tank when the evaluation step determines that cleaning is possible.

Further preferably, this printer cleaning method additionally comprises (d) a notification step for notifying that cleaning cannot be performed, this notification step being performed in place of the cleaning step when the evaluation step determines that cleaning is not possible.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

The preferred embodiments of the present invention are described below with reference to the accompanying figures.

Embodiment 1

Figure 1:
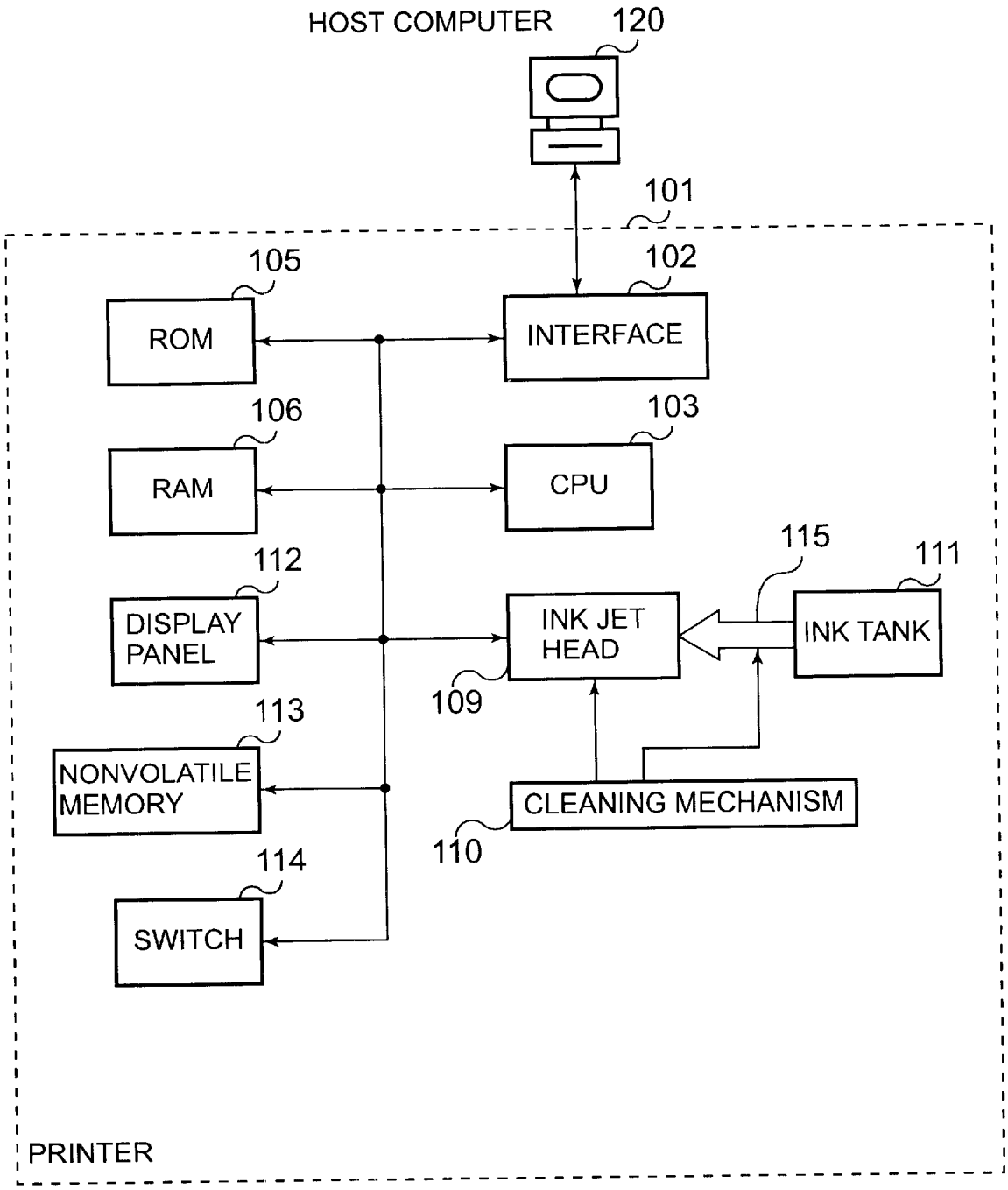
FIG. 1 is a block diagram of a printer according to a preferred embodiment of the present invention.

A printer according a first preferred embodiment of the present invention is described below with reference to FIG. 1, a block diagram thereof As will be known from FIG. 1, a printer 101 according to the present invention comprises an interface 102 through which the printer 101 communicates with a host computer 120 and receives print commands sent from the host computer 120.

Print commands received through the interface 102 are interpreted by a printer CPU 103, which then drives an ink jet head 109 to print text and/or images to paper or other print medium. In addition to commands for printing text or graphics, these print commands include a cleaning command.

The process performed by the CPU 103 is expressed as a program stored to a nonvolatile memory storage device or memory such as read-only memory (ROM) 105. As will be appreciated by one of ordinary other types of appropriate storage device such as semiconductor, optical, magneto-optical, magnetic and the like may be employed. When printer 101 power is turned on, the CPU 103 copies this program from ROM 105 to random access memory (RAM) 106, and then executes the program from the beginning. Alternatively, the program can be obtained from a medium such as a local area network (for example, an intranet), wide area network or a remote network (for example, the Internet).

The CPU 103 generates an image of the text and graphics to be printed in RAM 106, and uses this image to drive the ink jet head 109. Font information stored in ROM 105 is used to generate print images of text to be printed by referencing character codes for the text characters specified by the print command.

The printer 101 further comprises a cleaning mechanism 110 for cleaning the ink jet head 109. The ink jet head 109 draws ink from an ink tank 111 through an ink supply path 115, and ejects the supplied ink to print the text or graphics to paper, film, or other print medium.

Exemplary cleaning methods include the following:

(1) Removing ink that has increased in viscosity ("viscous ink" below) and bubbles in proximity to the nozzles by capping the nozzle surface of the ink jet head 109, suctioning ink by means of a pump through a tube connected to the cap, and collecting the waste ink into a waste ink reservoir.

(2) Flushing the nozzles to remove viscous ink by ejecting ink into the waste ink reservoir. This ink ejection step is unrelated to ejecting ink for printing.

(3) Wiping the nozzle surface to clean ink leakage and foreign matter from around the nozzles.

Figure 7:
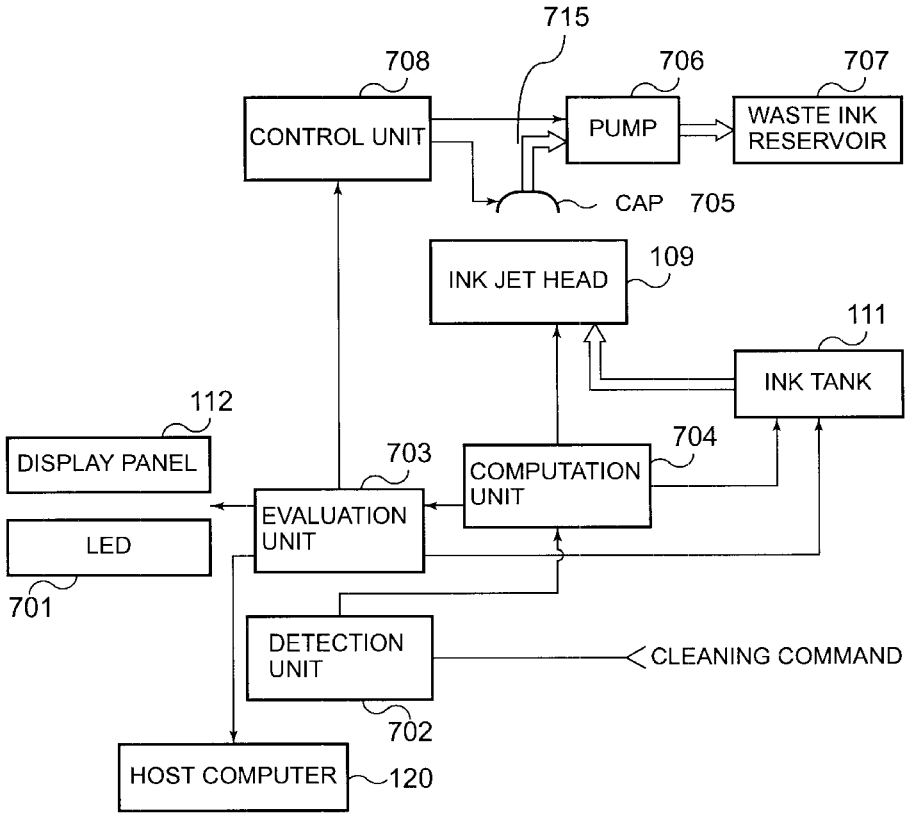
FIG. 7 is a block diagram illustrative of the claims of the present invention.

Referring to FIG. 7 the cleaning mechanism 110 comprises a nozzle surface cap 705, a tube 715 connected to the cap, a pump 706 connected to the tube 715, a waste ink reservoir 707, a rubber wiper for wiping the nozzle surface (not shown), and a motor for moving the wiper (not shown).

The printer 101 further comprises a display panel 112 for displaying information such as the current status of the printer 101. This status information includes whether the printer is on line, whether printing is in progress, and if there is no paper in the printer. When the remaining ink supply in the ink tank 111 drops to a specific level, it is also possible to indicate on the display panel 112 that the ink tank 111 needs to be replaced.

The printer 101 further comprises a switch 114 which can be operated to, for example, advance roll paper in the printer, advance a slip form, or initiate manual cleaning of the ink jet head 109.

The printer 101 yet further comprises nonvolatile memory 113, such as flash memory or an EEPROM, for storing how much ink has been consumed since use of the currently installed ink tank 111 began.

The interface 102, CPU 103, ROM 105, RAM 106, display panel 112, nonvolatile memory 113, and switch 114 are connected by, for example, a bus, that is using technology known from the literature and used in conventional printers.

It is to be noted here that the ink jet head 109 functions as the printing means of the accompanying claims; ink tank 111 functions as the ink storage means; cleaning mechanism 110 as the cleaning means; CPU 103 as the detection means (detection unit), evaluation means (evaluation unit), and control means (control unit); and the display panel 112 functions as the notification means (notification unit).

The interface 102 also functions as a notification means (notification unit), for example, for notifying the host computer 120 that the ink tank 111 must be replaced so that a notice to such effect is presented on the display of the host computer 120.

The ROM 105 also functions as a data storage medium for recording the cleaning program of the printer 101. Alternatively, a EEPROM, or similar device, may be employed instead of ROM 105 which can be updated from the host computer 120, a compact disc (CD-ROM), hard disk, floppy disk, magneto-optical disk, digital video disk (DVD), magnetic tape or other data storage medium used by the host computer 120 can be used as a data storage medium for recording the cleaning program of the printer 101. As noted above, the cleaning program may also be obtained from a medium, such as a local area network (for example, an intranet), wide area network or a remote network (for example, the Internet).In this case the CPU 103 receives the program through interface 102 and updates the content of the EEPROM 105 to the received program.

FIG. 7 is a block diagram corresponding to the accompanying claims of the present invention.

Ink for printing is supplied from the ink tank 111 to ink jet head 109. The ink ejection nozzles of the ink jet head 109 are capped by a cap 705 which can be placed in contact with the nozzle surface. Ink is suctioned from ink tank 111 by a pump 706 connected to the cap 705 by tube 715 to charge the ink jet head 109. Ink bubbles and foreign matter around the nozzle surface of the ink jet head 109 are suctioned by pump 706 through cap 705, and the suctioned waste ink is absorbed by an absorbent material in the waste ink reservoir 707.

The amount of ink used by this cleaning operation is determined by the suctioning time of the pump 706. The pump 706 and cap 705 are controlled by a control unit 708.

A detection unit 702 detects cleaning commands asserted by a switch being depressed or a timer, determines the type of cleaning operation to perform, and sends the detection result to a computation unit 704. The computation unit 704 computes the remaining ink volume in the ink tank 111, the ejected ink volume from the ink jet head 109, and the cleaning volume required for the cleaning operation detected by the detection unit 702. The computation unit 704 sends the computed result to the evaluation unit 703.

The evaluation unit 703 determines whether cleaning can be performed based on the computed result received from the computation unit 704. If cleaning is possible, the evaluation unit 703 informs the control unit 708 that a cleaning operation was detected and can be performed. If cleaning is not possible, the evaluation unit 703 instructs the display panel 112 or LED 701 to indicate that cleaning cannot be performed or ink tank replacement is necessary, and similarly notifies the host computer 120.

When the control unit 708 is informed by the evaluation unit 703 that a cleaning operation is required, it moves the ink jet head 109 to the cleaning position and wipes the nozzle surface with the wiper, flushes the nozzles, or moves the cap 705 to the nozzle surface to cap the nozzle surface, and drives the pump 706 to suction waste ink from the ink jet head.

Ink tank replacement

Figure 2:
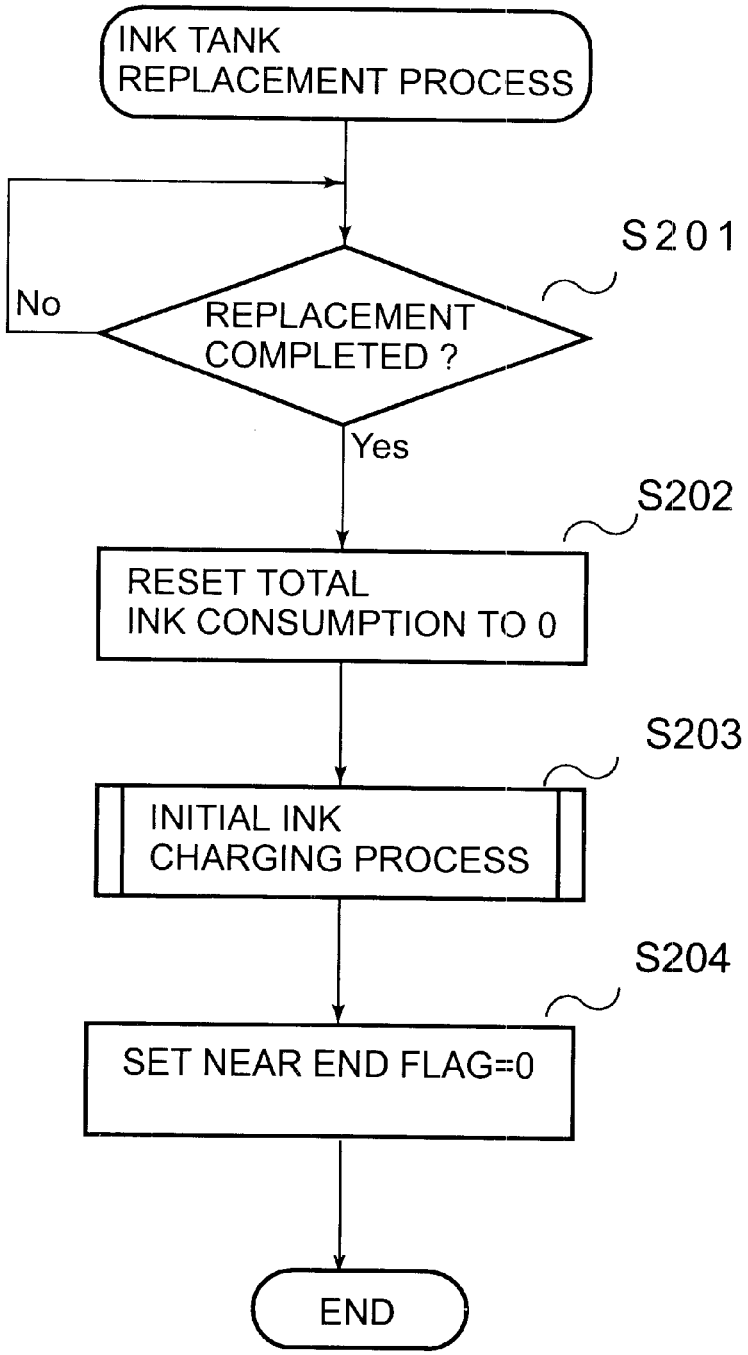
FIG. 2 is a flow chart of an ink tank replacement process performed by the printer shown in FIG. 1.

The ink tank replacement process performed when the ink tank is replaced in a printer according to the present invention is described next with reference to FIG. 2. FIG. 2 is a flow chart of ink tank replacement control.

The CPU 103 first detects the status of switch 114 to determine whether ink tank 111 replacement has been completed (step S201). It is therefore necessary for the printer 101 user to press switch 114 after replacing the ink tank 111 to notify the CPU 103 that ink tank replacement is completed. If ink tank replacement is not yet finished, step S201 returns no and loops back to itself.

If ink tank replacement has been completed and step S201 returns yes, the CPU 103 clears and resets to zero the value (total ink volume) stored to the used ink volume area reserved in nonvolatile memory 113 (step S202). The value stored in this used ink volume area increases as ink is consumed.

An initial ink charging routine is then performed (step S203). This initial ink charging routine arranges cap 705 (FIG. 7) on or adjacent to the ink jet head 109, and then suctions ink from the ink jet head 109 through the cap 705. The ink jet head 109 is thus filled with ink from the ink tank 111 through the tube 715.

The ink tank replacement process shown in FIG. 2 is completed, after the initial ink charging routine (step S203) is completed. (In step S204 ink near end flag is reset, if needed.

It is to be noted that the method taught in Japanese Patent Application 11-200873 by the assignee of the present invention is used for the initial ink charging process performed by a printer 101 according to the present invention. That document is incorporated herein by reference.

Printing process

Figure 3:
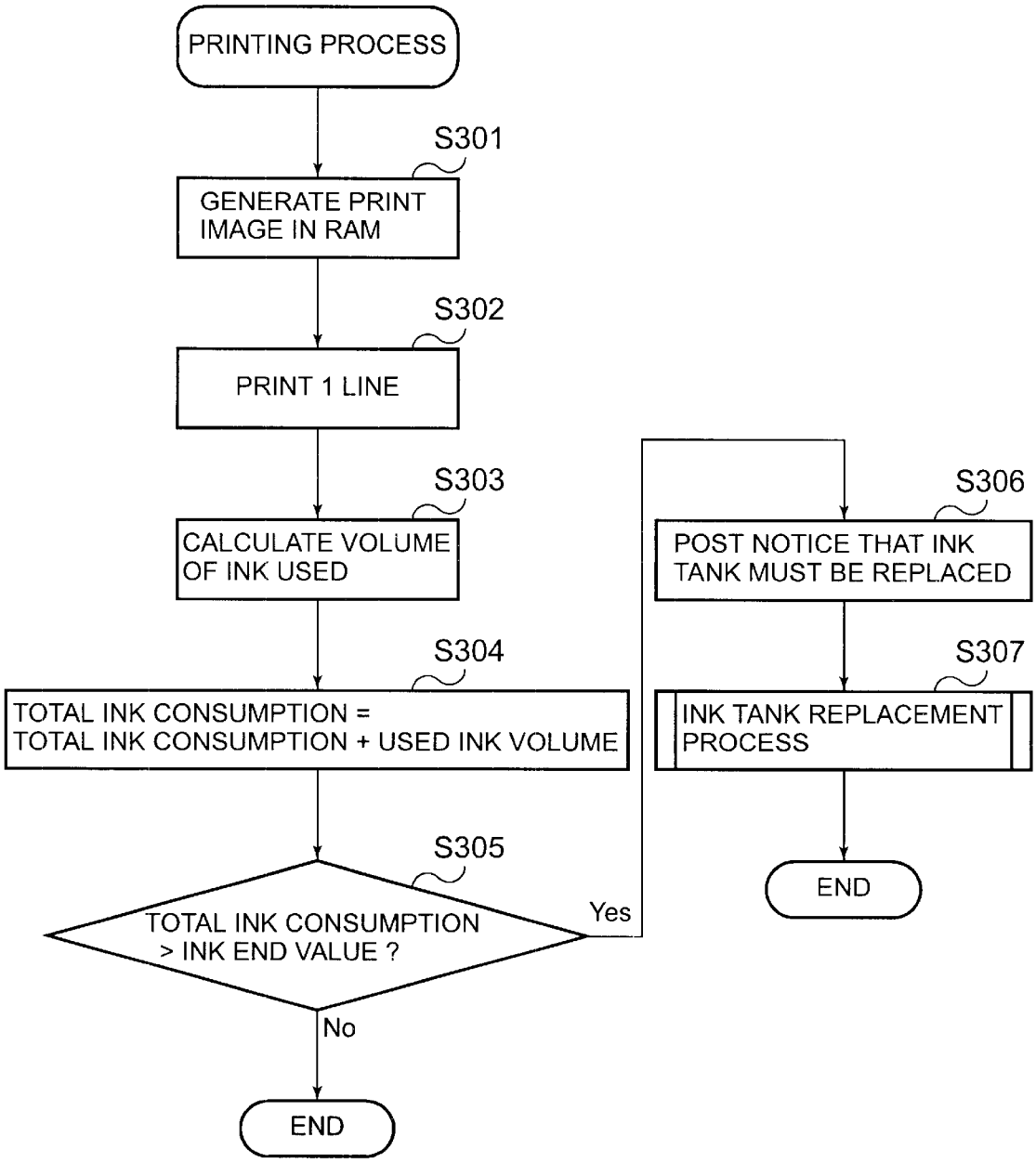
FIG. 3 is a flow chart of a printing process performed by the printer shown in FIG. 1.

A printing process whereby a printer according to the present invention prints text or graphics is described next below with reference to FIG. 3. FIG. 3 is a flow chart of printing process control.

The CPU 103 generates a print image in RAM 106 based on a print command sent from the host computer 120 and received via interface 102 (step S301). This print image is information indicating, for example, which dots are black and which are white. More specifically, the print image is the information used to drive the printing elements to eject ink in an exemplary ink jet head 109 having a 360 dpi by 128 dot nozzle array. In the case of a color printer, this print image will include information indicating which printing elements for what colors are to be driven to eject ink. Note that in either case a printing element typically comprises a nozzle and diaphragm, or a nozzle and heating element.

The CPU 103 then drives the printing elements of the ink jet head 109 based on the print image buffered to RAM 106 to print the desired text and/or images to the print medium (step S302). This step typically prints one line, which for printing to a standard A4 page in portrait orientation requires a serial head scanning distance of 210 mm in the horizontal direction. It is to be further noted that to print a black dot, a printing element of the ink jet head 109 is driven.

The CPU 103 then counts the number of black dots in the print image stored to RAM 106, that is, the number of times ink jet head 109 printing elements are driven, and calculates the volume of ink used for printing (step S303). The same operation is also performed for color printing. The ink volume used for printing can be determined because the number of times the printing elements of ink jet head 109 are driven in step S302 is known from the print image data in RAM 106. In addition, the ink volume consumed each time one printing element is driven is known by measuring the volume of ink ejected with each operation. For example, if 1 nanogram ($=10^{-9}$ g) of ink is ejected each time one nozzle is driven, 1 gram of ink is consumed for every 109 nozzle operations.

The ink volume thus calculated is then added to the value stored in the used ink volume area reserved in nonvolatile memory 113 (step S304). Total ink consumption, that is, the total amount of ink consumed from the ink tank 111 since the ink tank 111 was installed, is therefore stored in the used ink volume area of the nonvolatile memory 113.

The CPU 103 also determines whether the value stored in the used ink volume area, that is, total ink consumption, exceeds a specific value (the "ink end value" below) (step S305).

This ink end value can be determined by subtracting the maximum amount of ink required to print one full line, that is, the volume of ink consumed when all printing elements of the ink jet head 109 are driven to print every dot in one full line, from the volume of ink stored initially in the ink tank 111. This ink end value can therefore be considered a constant value determined by the type of ink tank 111 used.

The unit of the value stored in the used ink volume area is, for example, an ink dot equivalent. A typical ink tank may, for example, contain enough ink to print $10\times10^9$ dots, or 10 g of ink.

If total ink consumption exceeds the ink end value (step S305 returns yes), a display indicating that ink tank 111 replacement is required is displayed on the display panel 112, or a similar notice is sent to the host computer through interface 102 (step S306). The ink tank replacement process shown in FIG. 2, steps S201 to S203, is then performed (step S307), and the printing process ends.

If total ink consumption is less than or equal to the ink end value (step S305 returns no), this printing process ends immediately. In this case it is still possible to print at least one more line.

It is to be noted that while the process described above handles a print command for printing one line only, a plurality of lines can be printed by repeating this process (steps S301 to S307) for each line to be printed.

It is therefore possible by means of the present invention to reliably print one full line whenever a command to print one line is received, and it is therefore possible to prevent incomplete printing of any single line.

Cleaning process

Figure 4:
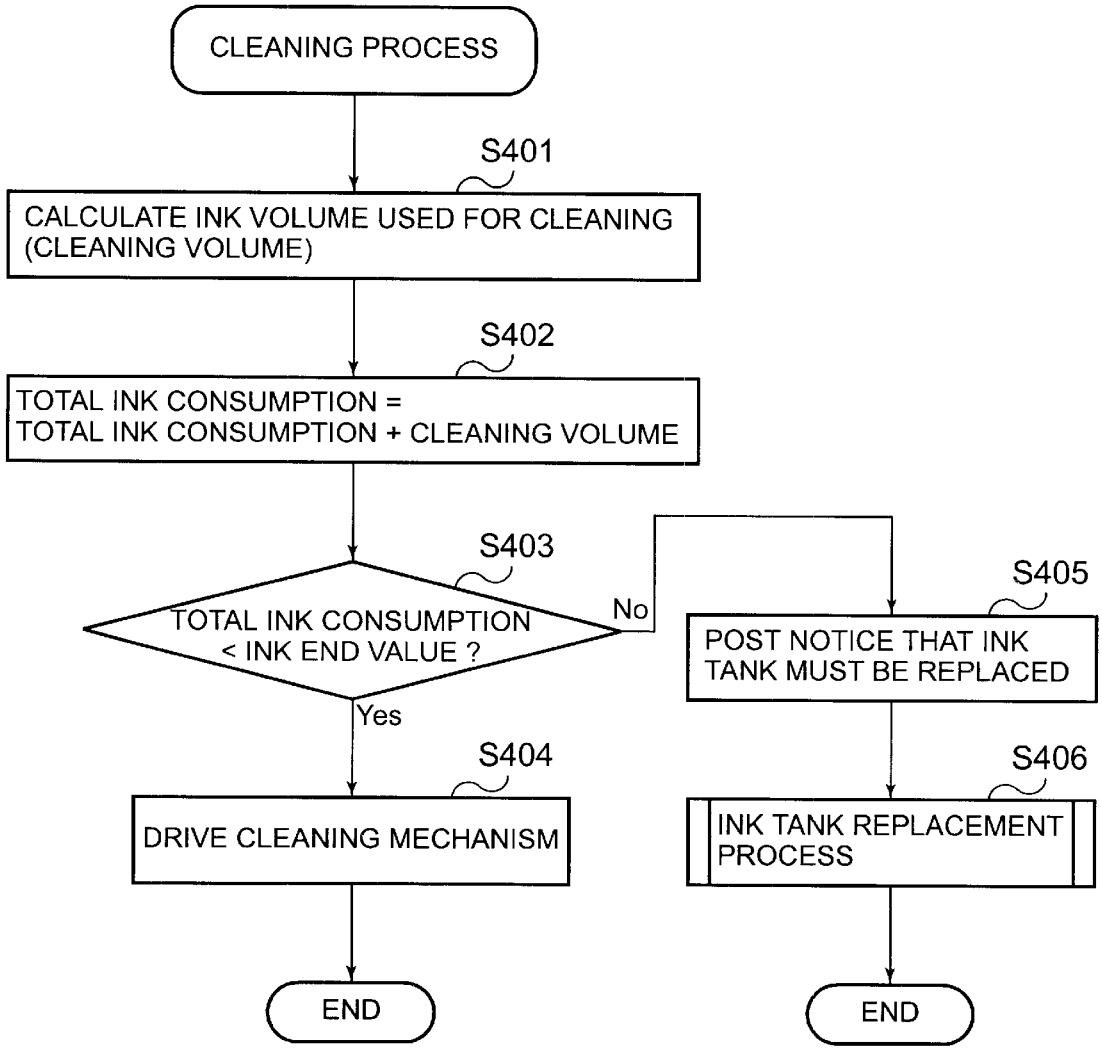
FIG. 4 is a flow chart of a cleaning process performed by the printer shown in FIG. 1.

A cleaning process according to the present invention for cleaning the printing mechanism of a printer according to the present invention is described next below with reference to FIG. 4, a flow chart of this cleaning process control.

The CPU 103 first detects the cleaning method to be used, and then calculates the ink volume required for the cleaning method (step S401). This ink volume is referred to below as the "cleaning volume." For example, if the user presses switch 114 to initiate manual cleaning, 5 mg of ink is suctioned from the nozzles. If five hours have passed since the last cleaning operation, 3 mg of ink is suctioned from the nozzles. After printing ten lines, all nozzles are flushed by ejecting one dot of ink from all nozzles. As a result, each cleaning operation consumes a different amount of ink.

The CPU 103 then adds the ink volume used for the cleaning operation, that is, the cleaning volume, to the value (the total ink consumption) stored in the used ink volume area of nonvolatile memory 113 (step S402).

Next, the CPU 103 determines whether the total ink consumption stored in the used ink volume area exceeds a specific value (the ink end value) (step S403). If it does not (step S403 returns no), the CPU 103 drives the cleaning mechanism 110 (step S404). The cleaning mechanism 110 then performs the particular cleaning operation to remove viscous ink or bubbles, for example, by suctioning ink from the nozzles through the cap, flushing the printing elements, or wiping the nozzle surface with a wiper. This cleaning process then ends.

If the total ink consumption exceeds the ink end value (step S403 returns yes), the ink supply will be depleted by the cleaning operation. In this case, therefore, a display indicating that ink tank 111 replacement is required is presented or a similar notice is sent to the host computer through interface 102 (step S405), the above-described ink tank replacement process shown in FIG. 2 is performed (step S406), and the cleaning process ends.

A printer and a printer cleaning method according to the present invention can thus prevent the ink supply from being depleted while a cleaning operation is in progress.

It is to be further noted that the above-described cleaning process is performed in such cases as when the ink tank 111 is replaced, a cleaning command sent by the host computer 120 is received through the interface 102, or printing is not performed for a specific period of time.

Whether printing has been performed within a specific period of time can be easily detected by storing the time of the last cleaning operation (step S404) or line printing operation (step S302) to nonvolatile memory 113, and comparing the current time with the stored time before printing commences in step S302.

There are cases in which the specific cleaning method will differ according to reason for the cleaning operation being performed, and such different cleaning methods can be easily accommodated by simply changing the ink consumption calculated in step S401 according to the selected method. Ink consumption by these different cleaning methods can also be experimentally determined.

Embodiment 2

Figure 5A:
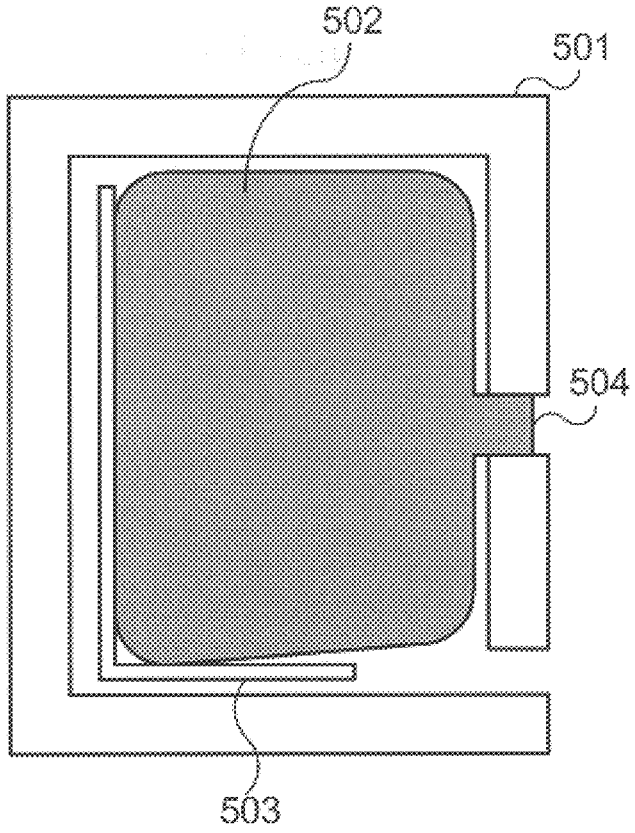
FIG. 5A is a typical section view of an ink tank used in a printer according to a second preferred embodiment of the present invention having an ink level of substantially full.
Figure 5B:
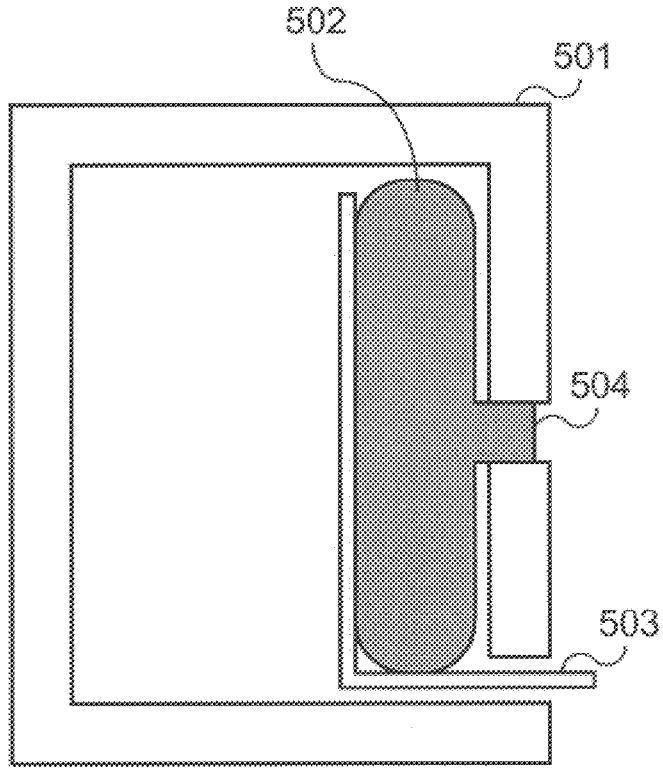
FIG. 5B is a typical section view of an ink tank used in a printer in which some ink has been consumed.

FIGS. 5A and 5B are typical section views of an ink tank used in a printer according to the second embodiment. As shown in FIGS. 5A and 5B, the ink tank 501 used in the present embodiment has a lever 503 disposed in contact with a sack 502 in which ink is stored. In FIG. 5A, the ink is at a substantially full level, while in FIG. 5B a quantity of ink has been consumed.

The ink tank 501 supplies ink through ink supply opening 504. As the remaining ink supply decreases, the sack 502 shrinks and lever 503 projects outside the ink tank 501 as shown in FIG. 5B.

Figure 6:
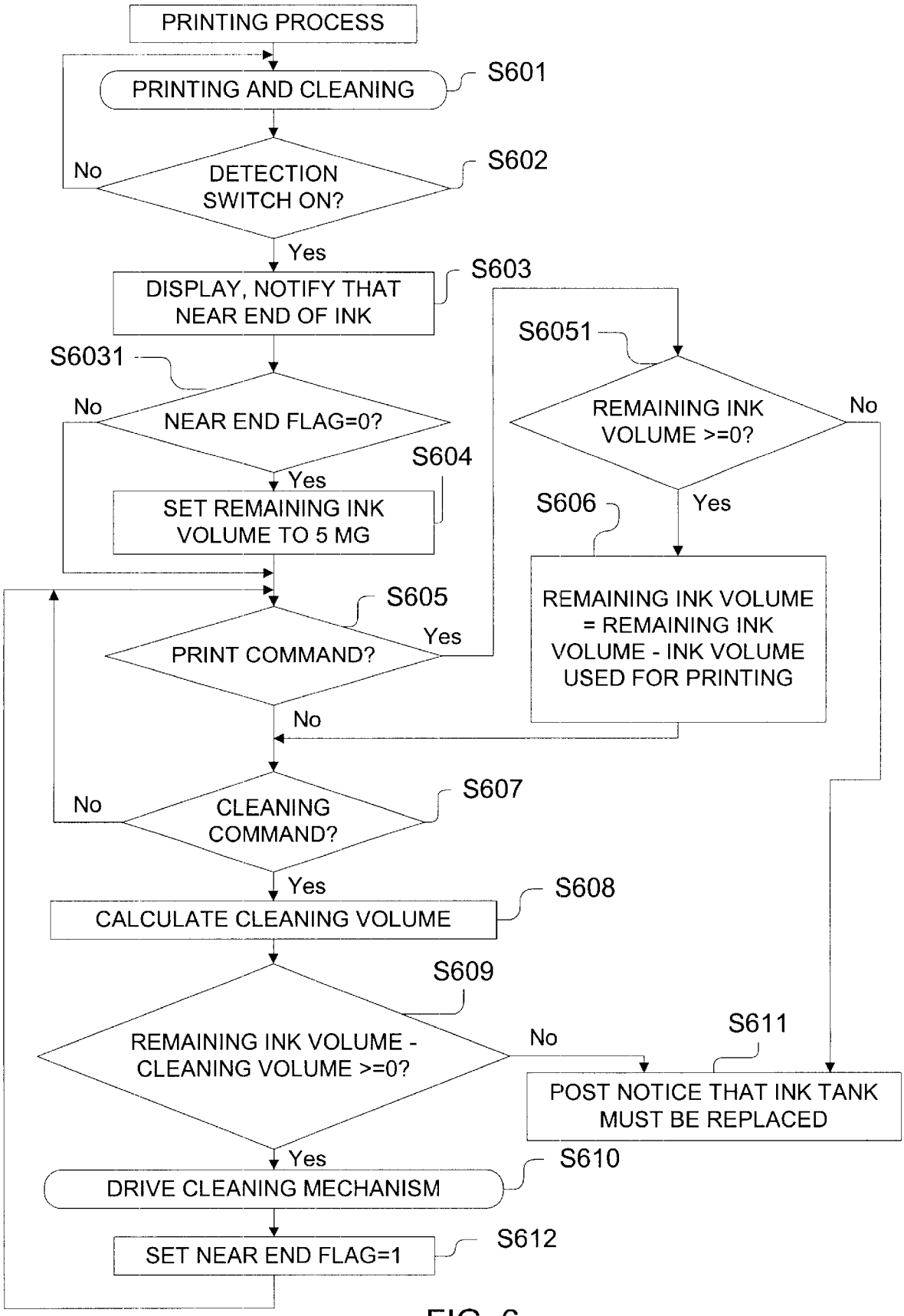
FIG. 6 is a flow chart of a cleaning process performed by a printer according to the second preferred embodiment of the present invention.

FIG. 6 is a flow chart of a printing process according to this preferred embodiment of the present invention.

The printer 101 in this exemplary embodiment further comprises a detection switch (not shown in the figure) that is depressed when the lever 503 projects from the ink tank 501. The CPU 103 monitors this detection switch, and performs cleaning and printing operations as required until the detection switch is pressed (step S601). When the detection switch is pressed (step S602 returns yes), the printer 101 indicates a "near end of ink" notice using the display panel 112 or by flashing an LED, for example. A near end of ink notice is also sent to the host computer 120 (step S603).

Here, the process determines whether ink near end flag (cf. FIG. 2 step S204) is set to 0 (step S6031). If near end flag is 0 (S6031, Yes) and since it is not yet near end, a remaining ink volume counter is then set to a specific value, which in this exemplary embodiment is 5 mg (step S604). If near end flag is 1 (S6031, No) and since it is already near end, it jumps to step S605.

Note that this remaining ink volume is set to the difference of the ink volume remaining in the sack 502 when the lever 503 projects and operates the detection switch of the printer minus the ink volume required to print one row.

There are often cases in which the user will continue printing without immediately replacing the ink tank when the near end of ink notice is posted. As a result, when a print command is next received (step S605 returns yes), and remaining ink volume is checked at Step S6051, if S6051 is Yes, then the ink consumed by the print operation is subtracted from the remaining ink volume, and the difference is stored as the new remaining ink volume (step S606). If S6051 is No, then print operation does not occur and step S611 is then processed.

In step S607, the CPU 103 then waits for a cleaning command. When a cleaning command is received, the CPU 103 calculates the ink volume required for the cleaning operation, that is, the above-noted cleaning volume (step S608). Note that a cleaning command is asserted by the user pressing a manual cleaning switch, the passage of a specific period since the last cleaning operation, or other cause as described above in the first embodiment. The cleaning volume is then subtracted from the remaining ink volume. If the cleaning volume is greater than the remaining ink volume (step S609 returns no), the cleaning mechanism is not driven, the user is notified that ink tank replacement is required using an LED, display panel 112, and/or notifying the host computer 120 (step S611), and the printing process ends.

If the cleaning volume is less than the remaining ink volume (step S609 returns yes), ink jet head cleaning is possible. The cleaning mechanism is therefore driven (step S610) to suction an ink volume determined by the selected cleaning method, and ink near end flag is set (step S612), then it is returned to S605.

It should be noted that the total ink consumption and remaining ink volume are compared (steps S305 and S403 in the first embodiment above) only when the detection switch is depressed in this embodiment of the present invention. As a result, the detection switch of a printer 101 according to this preferred embodiment of the invention functions as the detection means of the claims.

It should be further noted that if the remaining ink volume is 3 mg and a cleaning command that consumes 5 mg of ink is received, a notice requesting ink tank replacement is immediately posted by the process shown in the flow chart in FIG. 6. Unnecessary cleaning operations can therefore be prevented, the user can be immediately requested to replace the ink tank, and printer throughput can thus be improved.

As will be known from the above description of preferred embodiment, the present invention provides the following benefits.

First, the present invention provides a printer and a cleaning method therefor whereby ink tank replacement is immediately requested and enabled without attempting to perform cleaning operations that cannot be completed and would waste time to attempt.

In addition, the present invention provides a printer and a cleaning method therefor whereby cleaning and ink tank replacement operations are performed with consideration for the various types of cleaning operations required for different circumstances.

Furthermore, a medium is provided having a printer cleaning program which can be easily distributed and marketed as a software product independently of the printer.

Yet further, a printer and printer cleaning method therefor can be achieved and the benefits thereof obtained by executing the program stored on a data storage medium according to the present invention on an existing printer.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

(a) an ink tank to store ink;

(b) an ink jet head in communication with said ink tank to print text or image;

(c) a cleaning mechanism to clean said ink jet head consuming a predetermined volume of ink;

(d) a detection unit to detect a command instructing said cleaning mechanism to clean said ink jet head;

(e) an evaluation unit responsive to said detection unit to determine if a volume of ink remaining in said ink tank is greater than the predetermined volume of ink; and (f) a control unit for driving said cleaning mechanism to clean said ink jet head when said evaluation unit determines the volume of ink remaining in said ink tank is greater than the predetermined volume of ink, and for prohibiting any cleaning of said head when said evaluation unit determined the volume of ink remaining in said ink tank is not greater than the predetermined volume of ink.

2. A printer as set forth in claim 1, further comprising:

(h) a calculation unit to calculate the volume of ink remaining in said ink tank based on the predetermined volume and a volume of ink consumed by said ink jet head while printing;

wherein said evaluation unit is responsive to said calculation unit.

3. The printer of claim 1, wherein the use of said head to print text or images is continued to be permitted even after the volume of ink remaining in said ink tank is not greater than said predetermined volume of ink.

4. A printer comprising:

(a) ink storage means for storing ink;

(b) printing means in communication with said ink storage means for printing text or image;

(c) cleaning means for cleaning said printing means consuming a predetermined volume of ink;

(d) detection means for detecting a command instructing said cleaning means to clean said printing means;

(e) evaluation means responsive to said detection means for determining if a volume of ink remaining in said ink storage means is greater than the predetermined volume of ink; and (f) control means for driving said cleaning means to clean said printing means when said evaluation means determines the volume of ink remaining in said ink storage means is greater than the predetermined volume of ink, and for prohibiting any cleaning of said head when said evaluation unit determined the volume of ink remaining in said ink tank is not greater than the predetermined volume of ink.

5. A printer as set forth in claim 4, further comprising:

(h) calculation means for calculating the volume of ink remaining in said ink storage means based on the predetermined volume and a volume of ink consumed by said printing means while printing;

wherein said evaluation means is responsive to said calculation means.

6. The printer of claim 4, wherein the use of said head to print text or images is continued to be permitted even after the volume of ink remaining in said ink storage means is not greater than said predetermined volume of ink.

7. A printer cleaning method comprising the steps of:

(a) detecting a command for instructing cleaning of an ink jet head consuming a predetermined volume of ink;

(b) determining whether the volume of ink remaining in an ink tank is greater than the predetermined volume after step (a);

(c) cleaning the ink jet head using ink remaining in the ink tank if the volume of ink remaining is greater than the predetermined volume as determined in step (b); and (c2) prohibiting any cleaning of the ink jet head if the volume of ink remaining is not greater than the predetermined volume as determined in step (b).

8. The printer cleaning method as set forth in claim 7, further comprising the step of:

(d) notifying if the volume of ink stored is less than the predetermined volume as determined in step (b).

9. The printer cleaning method as set forth in claim 7, further comprising the step of:

calculating the volume of stored ink after the cleaning step and printing by the ink jet head;

wherein the determining step is based on the volume calculated in the calculating step.

10. The printer cleaning method of claim 7, wherein the use of said ink jet head to print text or images is continue to be permitted even after the volume of ink remaining in said ink tank is not greater than said predetermined size.

11. A data storage medium containing a printer cleaning program comprising the steps of:

(a) detecting a command for instructing cleaning of an ink jet head consuming a predetermined volume of ink;

(b) determining whether the volume of ink stored is greater than the predetermined volume after step (a);

(c) cleaning the ink jet head using ink stored if the volume of ink stored is greater than the predetermined volume as determined in step (b); and (c2) prohibiting any cleaning of the ink jet head if the volume of ink remaining is not greater than the predetermined volume as determined in step (b).

12. The data storage medium as set forth in claim 11, wherein said cleaning program further comprising the step of:

(d) notifying if the volume of ink stored is less than the predetermined volume as determined in step (b).

13. The data storage medium as set forth in claim 11, wherein said cleaning program further comprising the step of:

calculating the volume of stored ink after the cleaning step and printing by the ink jet head;

wherein the determining step is based on the volume calculated in the calculating step.

14. The data storage medium as set forth in claim 11, wherein said medium is a computer-readable medium selected from the group consisting of compact disc (CD), floppy disk, hard disk, magneto-optical disk, digital video disk (DVD), and magnetic tape.

15. The data storage medium as set forth in claim 11, wherein said medium is incorporated into a network selected from the group consisting of a local area network, a wide area network, and the Internet.

16. The data storage medium of claim 11 wherein said program further comprises the step of permitting the continued use of said ink jet head to print text or images even when the ink remaining is not greater than the predetermined volume.

17. A printer comprising:

(a) an ink tank to store ink;

(b) an ink jet head in communication with said ink tank to print text or image;

(c) a cleaning mechanism to clean said ink jet head consuming a predetermined volume of ink;

(d) a detection unit to detect a command instructing said cleaning mechanism to clean said ink jet head;

(e) a detector to detect when the volume of ink remaining in said ink tank is below a threshold level;

(f) an evaluation unit responsive to said detection unit to determine if the volume of ink remaining in said ink tank is greater than the predetermined volume of ink when the volume of ink remaining in said ink tank is below the threshold level as detected by said detector; and (g) a control unit to drive said cleaning mechanism to clean said ink jet head when said evaluation unit determines the volume of ink remaining in said ink tank is greater than the predetermined volume of ink, and for prohibiting any cleaning of said ink jet head when said evaluation unit determined the volume of ink remaining in said ink tank is not greater than the predetermined volume of ink.

18. The printer of claim 17, wherein the use of said ink jet head to print text or images is continued to be permitted even after the volume of ink remaining in said ink tank is not greater than the predetermined volume of ink.

19. A printer comprising:

(a) ink storage means for storing ink;

(b) printing means in communication with said ink storage means for printing text or image;

(c) cleaning means for cleaning said printing means consuming a predetermined volume of ink;

(d) command detection means for detecting a command instructing said cleaning means to clean said printing means;

(e) level detecting means for detecting when the volume of ink remaining in said ink storage means is below a threshold level;

(f) evaluation means responsive to said command detection means for determining if the volume of ink remaining in said ink storage means is greater than the predetermined volume of ink when the volume of ink remaining in said ink storage means is below the threshold level as detected by said level detecting means; and (g) control means for driving said cleaning means to clean said printing means when said evaluation means determines the volume of ink remaining in said ink storage means is greater than the predetermined volume of ink, and for prohibiting any cleaning of said printing means when said evaluation unit determined the volume of ink remaining in said ink storage means is not greater than the predetermined volume of ink.

20. The printer of claim 19, wherein the use of said printing means to print text and images is continued to be permitted even after the volume of ink remaining in said ink stage means in not greater than the predetermined volume of ink.

21. A printer cleaning method comprising the steps of:

(a) determining a predetermined volume of ink for cleaning an ink jet head;

(b) detecting a cleaning command;

(c) detecting when a volume of stored ink remaining is below a threshold level;

(d) determining if the volume of stored ink remaining is greater than the predetermined volume of ink when the volume of stored ink remaining is below the threshold level as detected in step (c) after detecting the cleaning command in step (b); and (e) cleaning the ink jet head when step (d) determines the volume of stored ink remaining is greater than the predetermined volume of ink, and prohibiting any cleaning of the ink jet head when step (d) determines the volume of stored ink remaining is not greater than the predetermined volume of ink.

22. The printer cleaning method of claim 21, wherein the use of said ink jet head to print text and images is continued to be permitted even after the volume of stored ink remaining in not greater than the predetermined volume of ink.

23. A data medium for a printer cleaning program comprising the steps of:

(a) determining a predetermined volume of ink for cleaning an ink jet head;

(b) detecting a cleaning command;

(c) detecting when a volume of stored ink remaining is below a threshold level;

(d) determining if the volume of stored ink remaining is greater than the predetermined volume of ink when the volume of stored ink remaining is below the threshold level as detected in step (c) after detecting the cleaning command in step (b); and (e) cleaning the ink jet head when step (d) determines the volume of stored ink remaining is greater than the predetermined volume of ink, and prohibiting any cleaning of the ink jet head when step (d) determines the volume of stored ink remaining is not greater than the predetermined volume of ink.

24. The data medium of claim 23, wherein the printer cleaning program further comprises continues to permit the use the ink jet head to print text or image even when the volume of stored ink remaining is not greater than the predetermined volume of ink.

* * * * *

UNITED STATES PATENT AND TRADEMARK OFFICE

CERTIFICATE OF CORRECTION

PATENT NO. : 6,491,367 B1
DATED : December 10, 2002
INVENTOR(S) : Masayo Miyasaka et al.

It is certified that error appears in the above-identified patent and that said Letters Patent is hereby corrected as shown below:

Title page,
Item [56], References Cited, U.S. PATENT DOCUMENTS, add:
-- 5,635,961, 6/1997, Sato --.

Column 14,
Line 5, change "continues" to -- continuing --.

Signed and Sealed this

Twelfth Day of August, 2003

JAMES E. ROGAN
*Director of the United States Patent and Trademark Office*